US005381841A

United States Patent [19]

Weil

[11] Patent Number: 5,381,841

[45] Date of Patent: Jan. 17, 1995

[54] TANGENTIAL ROTARY SLICER

[75] Inventor: George Weil, Mississauga, Canada

[73] Assignee: David R. Webb Co., Inc., Edinburgh, Ind.

[21] Appl. No.: 25,156

[22] Filed: Mar. 1, 1993

Related U.S. Application Data

[63] Continuation-in-part of Ser. No. 927,153, Aug. 7, 1992, abandoned, which is a continuation of Ser. No. 800,642, Nov. 27, 1991, Pat. No. 5,150,746, which is a continuation-in-part of Ser. No. 702,774, May 17, 1991, Pat. No. 5,101,874.

[51] Int. Cl.[6] ..... B27L 5/02

[52] U.S. Cl. ..... 144/209 B; 269/50; 144/177; 144/369; 144/209 R

[58] Field of Search ..... 144/162 R, 177, 128, 144/209 R, 209 B, 365, 369; 269/47, 50

[56] References Cited

U.S. PATENT DOCUMENTS

| | | | |
|---|---|---|---|
| 144,938 | 11/1873 | Williams . | |
| 793,306 | 6/1905 | Koss . | |
| 828,065 | 8/1906 | Smith . | |
| 2,261,497 | 11/1941 | Hill | 144/209 |
| 3,073,363 | 1/1963 | Lofstedt | 144/209 |
| 3,078,887 | 2/1963 | Heth | 144/209 |
| 3,110,330 | 11/1963 | Heth | 144/209 |
| 3,132,673 | 5/1964 | Bamford | 144/209 |
| 3,441,069 | 4/1969 | Koss | 144/309 |
| 3,506,045 | 4/1970 | Bosco | 144/209 |
| 3,680,612 | 8/1972 | Hale | 144/178 |
| 3,905,408 | 9/1975 | Hale | 144/178 |
| 4,089,354 | 5/1978 | Cremona | 144/178 |
| 4,313,481 | 2/1982 | Cremona | 144/209 |
| 4,323,101 | 4/1982 | Cremona | 144/323 |
| 4,587,616 | 5/1986 | Weil | 365/475 |
| 4,922,979 | 5/1990 | Crabtree | 144/357 |
| 5,143,129 | 9/1992 | Toivio | 144/209 R |

FOREIGN PATENT DOCUMENTS 29479 6/1909 Sweden .

*Primary Examiner*—W. Donald Bray
*Attorney, Agent, or Firm*—Barnes & Thornburg

[57] ABSTRACT

A veneer slicer includes a mandrel for holding multiple flitches. The mandrel has a first axis about which it is rotated. A knife and pressure bar assembly is provided on a first reciprocable carriage. The carriage is reciprocated toward and away from the first axis of rotation as the flitches are carried around the first axis of rotation on the mandrel. The mandrel is reciprocated along the first axis of rotation. Rotation of the mandrel, coupled with reciprocation of the carriage and mandrel respectively toward and away from the first axis of rotation and along the first axis of rotation, causes veneer to be sliced sequentially from the multiple flitches.

13 Claims, 4 Drawing Sheets

TANGENTIAL ROTARY SLICER

This is a continuation-in-part of my earlier filed and co-pending application Ser. No. 07/927,153 filed Aug. 7, 1992, and now abandoned titled TANGENTIAL ROTARY SLICER and assigned to the same assignee as this application, which is a continuation of my earlier filed application Ser. No. 07/800,642, filed Nov. 27, 1991 now U.S. Pat. No. 5,150,746, which is a continuation-in-part of my earlier filed application Ser. No. 07/702,774, filed May 17, 1991 now U.S. Pat. No. 5,101,874. The disclosures of these related applications are hereby incorporated herein by reference.

This invention relates to veneer slicers. It is disclosed in the environment of a rotary slicer which has the capability to slice sheets from multiple flitches with each rotation of a flitch carriage, but is believed to be useful in other types of veneer slicers as well.

Veneer slicers are known. There are, for example, the slicers of U.S. Pat. Nos.: 144,938; 793,306; 828,065; 2,261,497; 3,441,069; 3,680,612; 3,905,408; 4,089,354; 4,313,481; 4,323,101, and 4,587,616; and Swedish Patent Specification 29,479. Veneer lathes, also called veneer peelers and log peelers, are also known. There are, for example, the veneer lathes of U.S. Pat. Nos. 3,073,363; 3,078,887; 3,110,330; 3,132,673; 3,506,045; and, 4,922,979.

The invention may best be understood by referring to the following description and accompanying drawings which illustrate the invention. In the drawings.

Figure 1:
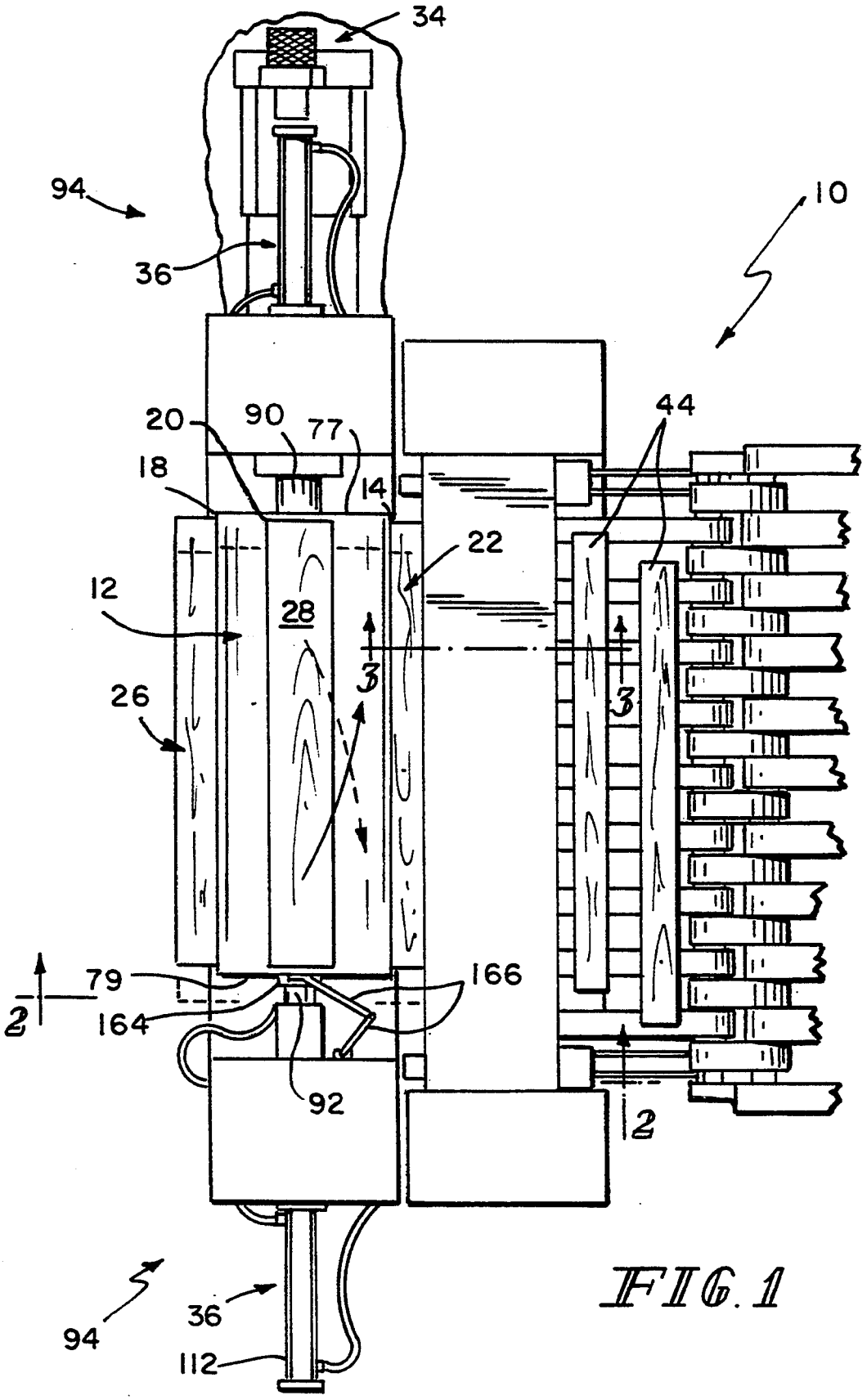
Fig. 1 illustrates a fragmentary side elevational view of a system according to the present invention.
Figure 2:
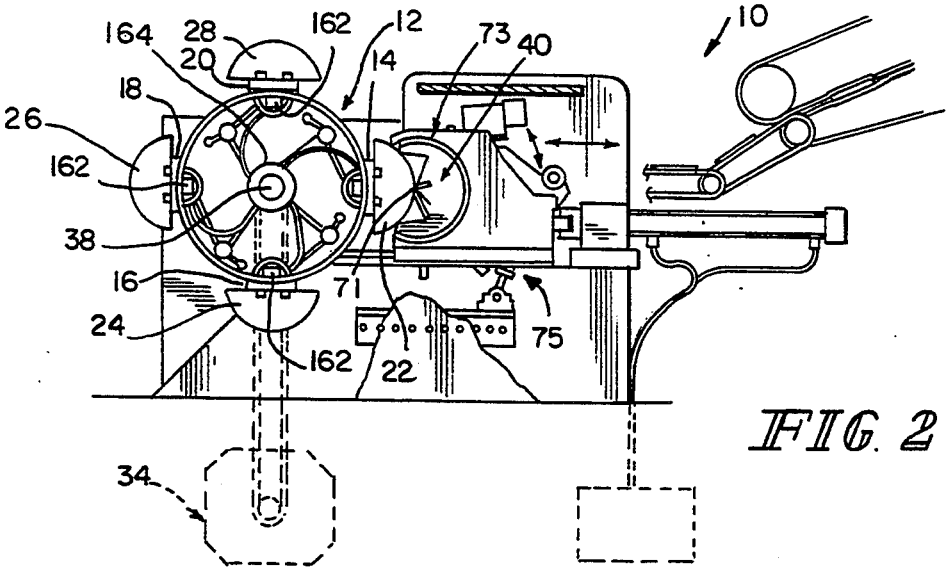
Fig. 2 illustrates a fragmentary top plan view of the system illustrated in FIG. 1.

Referring now to FIGS. 1–2 a veneer slicing and stacking operation 10 is illustrated in side elevation and top plan, respectively. Instead of the log which a veneer lathe spins between chucks provided in pedestals at the opposite ends thereof, the lathe is provided with a generally circular cross section, rotary flitch carriage, or mandrel, 12. Mandrel 12 has four flitch holding stations 14, 16, 18 and 20. A flitch 22, 24, 26, 28 is held at each station 14, 16, 18, 20, respectively, by slicer dogs 32 (FIGS. 5–6) of a configuration which will subsequently be discussed in greater detail. Mandrel 12 is also coupled to prime movers 34, 36, one, 34, of which rotates mandrel 12 at a controlled rate of, for example, ≦25 rpm about its rotational axis 38, and the other, 36, of which shifts the mandrel 12 along its own rotational axis 38 at a controlled rate during the slicing of sheets of veneer from each of flitches 22, 24, 26, 28. This slicing action is known in the context of prior art veneer slicers, for example, the slicers illustrated and described in U.S. Pat. Nos. 2,303,213 and 2,676,627. A carriage 40 supports a knife and pressure bar assembly 42 of known configuration.

Carriage 40 moves synchronously with mandrel 12 in several ways. First, carriage 40 steps linearly toward mandrel 12 once each complete rotation of mandrel 12. The size of each such step is determined by the desired thicknesses of the sheets 44 of veneer which are to be sliced from flitches 22, 24, 26, 28 as mandrel 12 rotates. A second motion, which is superimposed on the first, is a back-and-forth reciprocation of carriage 40, continuously synchronized to the rotation of mandrel 12. In other words, this second, reciprocating, motion is not simply a step toward mandrel 12 once each complete rotation of mandrel 12. Rather, this second motion reconciles the radial position of the knife and pressure bar assembly 42 with respect to the axis 38 of mandrel 12 on the one hand with the desired transverse sectional profiles of the sheets 44 of veneer on the other. For example, FIG. *7a* illustrates somewhat exaggerated a convexly bowed profile cut 50 on a flitch 52. This cut 50 produces slightly outwardly bowed sheets of veneer after the first sheet has been taken off. This cut 50 requires either no additional motion or only a slight reciprocating motion of carriage 40 toward axis 38 to be made at a fairly linear rate from the time the flitch 52 engages knife 54 until knife 54 reaches the halfway point 56 in its cut. Then knife 54 is reciprocated in the same fashion away from axis 38.

FIG. *7b* illustrates in somewhat exaggerated fashion a flat profile cut 60 on a flitch 62. This cut 60 produces flat sheets of veneer after the first sheet has been taken off. This cut 60 requires slightly more reciprocation of carriage 40 toward axis 38 than did cut 50 of FIG. *7a*. However, again, the reciprocation can be made at a fairly linear rate from the time the flitch 62 engages knife 64 until knife 64 reaches the halfway point 66 in its cut. Then knife 64 is reciprocated at the same rate away from axis 38.

FIG. *7c* illustrates in somewhat exaggerated fashion a concavely bowed profile cut 70 on a flitch 72. This cut 70 produces slightly concavely bowed sheets of veneer after the first sheet has been taken off. This cut 70 requires slightly more reciprocation of carriage 40 toward axis 38 than did cut 60 of FIG. *7b*. However, again, the reciprocation can be made at a fairly linear rate from the time the flitch 72 engages knife 74 until knife 74 reaches the halfway point 76 in its cut. Then knife 74 is reciprocated at the same rate away from axis 38.

Figure 3:
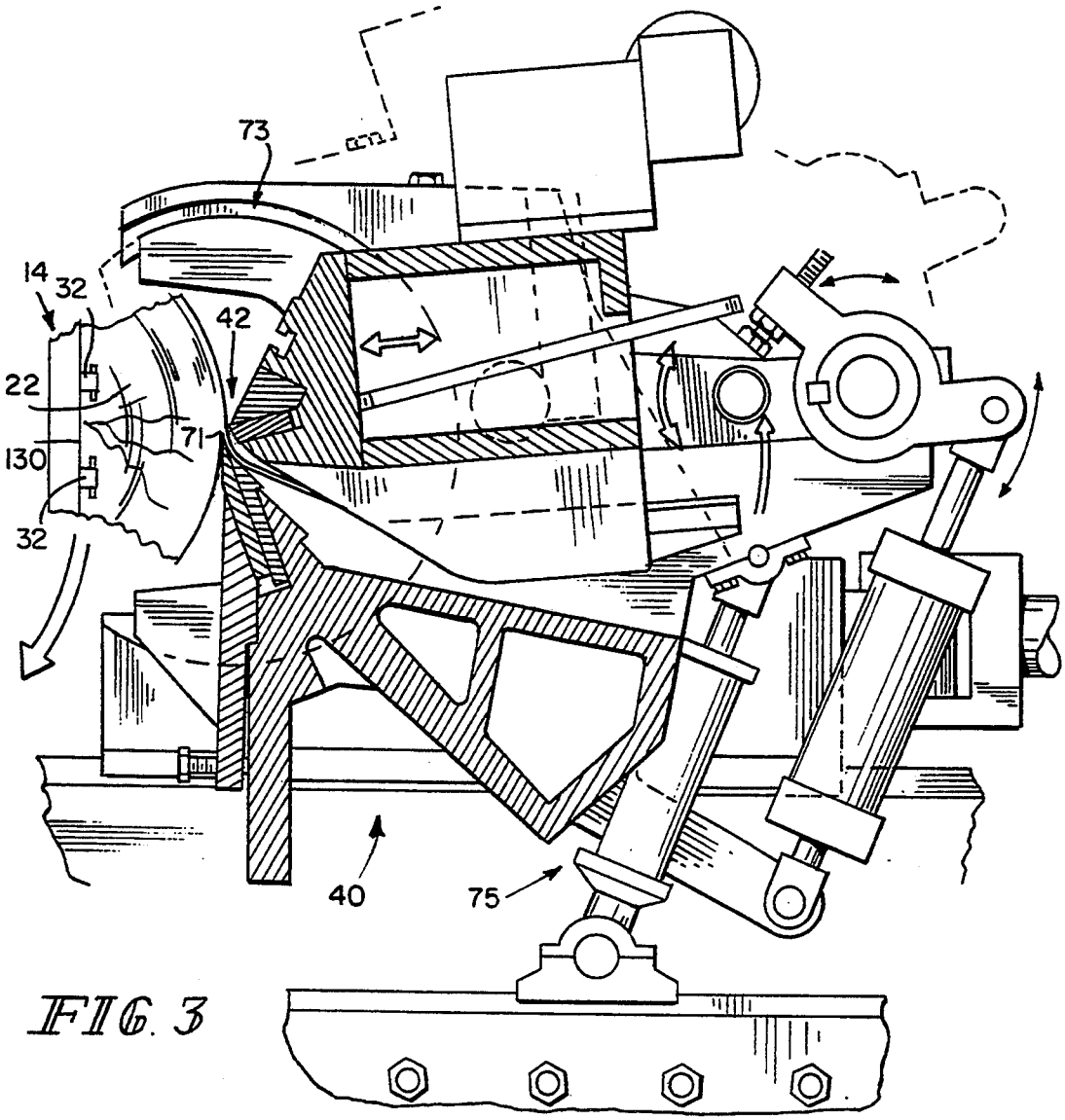
FIG. 3 illustrates an enlarged fragmentary plan side elevational views of a detail of the system illustrated in FIGS. 1–2.

Third, it must be recognized that the angular orientation between the knife and pressure bar assembly 42 and the surface of the flitch 22, 24, 26, 28 which is being cut should be maintained substantially constant as the flitch 22, 24, 26, 28 is rotated on mandrel 12 past the knife and pressure bar assembly 42. This condition can be approximated by making the diameter of the mandrel 12 itself sufficiently large. A diameter on the order of 3½ to 4 feet (about 1.07 to about 1.22 meters) is sufficient to render any angular reorientation of the knife and pressure bar assembly 42 relative to the mandrel 12 unnecessary. However, for mandrels 12 having smaller diameters, it may be necessary or desirable to account for changes in the angular orientation of the knife and pressure bar assembly 42 relative to the surfaces of the flitches 22, 24, 26, 28 as the flitches 22, 24, 26, 28 on mandrel 12 sweep past the knife and pressure bar assembly 42. This can be achieved as illustrated in FIG. 3 by mounting the knife and pressure bar assembly 42 for rocking motion through an arc of a circle whose center 71 lies on the cutting edge of the knife. Arcuate trunnion bushings 73 at both ends of the knife and pressure bar assembly 42, of the type found on conventional veneer lathes, are suited to this task. The motion is provided by, for example, a linear piston and cylinder hydraulic motor 75 at each end of carriage 40. One end of each hydraulic motor 75 is fixed to a respective end of carriage 40. The other end of each hydraulic motor 75 is fixed to a respective end of knife and pressure bar assembly 42. The rate at which the knife and pressure bar assembly 42 is rocked and the magnitude of such rocking are determined by, among other things, the surface speed of the flitch 22, 24, 26, 28 past the knife and pressure bar assembly 42 and the circumferential length of the cut, since a substantially constant angular orientation should be maintained between the knife and the flitch 22, 24, 26, 28 surface being cut.

It should be understood that the control system for controlling the motion of carriage 40 must be capable of accounting not only for the desired veneer slice 44 thickness and profile 50, 60, 70, and shifting of mandrel 12 longitudinally along its rotational axis 38 toward its end 77 during slicing from one flitch and toward its end 79 during slicing of the next flitch. It must also take into account that as the flitches 22, 24, 26, 28 are sliced, the rate of rotation of the mandrel 12 may need to be adjusted to maintain a constant flitch 22, 24, 26, 28 surface velocity past the knife and pressure bar assembly 42. Thus, as the flitches 22, 24, 26, 28 are sliced, the rotation rate of the mandrel 12 may need to be increased to achieve constant surface velocity of the flitches 22, 24, 26, 28 past the knife and pressure bar assembly 42. The controller must also take into account that, owing to the increasing width of each flitch 22, 24, 26, 28 nearer the mandrel 12, contact between the flitch 22, 24, 26, 28 and the knife and pressure bar assembly 42 will occur sooner in each successive rotation of the mandrel 12, and will terminate later in each successive rotation of the mandrel 12. The controller can sense slight changes in the rate of rotation of mandrel 12 when the knife and pressure bar assembly 42 contacts, and while it remains in contact with, a flitch 22, 24, 26, 28 which is being sliced. Control systems which serve these functions are known. Reference is here made to the above-noted control system disclosures, which are hereby incorporated herein by reference.

Mandrel 12 is also shifted linearly along its rotational axis 38, first toward one, 77, of its ends during cutting of a sheet of veneer from one of flitches 22, 24, 26, 28 and then linearly back along its rotational axis toward the other, 79, of its ends during the cutting of a sheet of veneer from the next adjacent one of flitches 22, 24, 26, 28.

Figure 4:
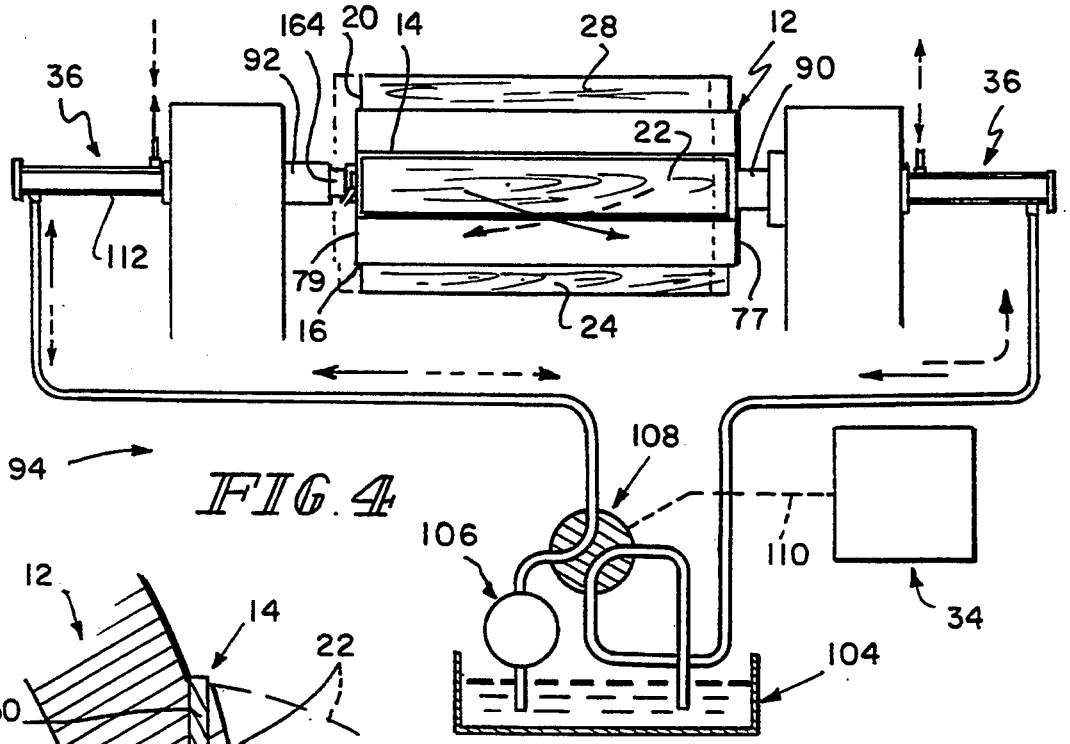
FIG. 4 illustrates an enlarged sectional view of a detail of the system illustrated in FIGS. 1–2, taken generally along section lines 4—4 of FIG. 1.

The means by which mandrel 12 is shifted longitudinally of its rotational axis 38 first in one direction and then in the other as veneer is sliced first from one flitch and then from the next adjacent one is best illustrated in FIGS. 2 and 4. Mandrel 12 is provided at its ends with spindles 90, 92 of the type found on conventional veneer lathes. In such installations these spindles 90, 92 work simultaneously inward to chuck a log to be peeled into veneer between them and outward to release the core which remains at the end of such a peeling operation. In the present invention, the actuating mechanism 94 for spindles 90, 92 has been modified so that, rather than moving toward each other as they would during the chucking operation and away from each other as they would during the releasing operation, they both move first in one direction as one of flitches 22, 24, 26, 28 is sliced and then in the opposite direction as the next adjacent one of flitches 22, 24, 26, 28 is sliced. Spindles 90, 92 always maintain a constant distance between them, that distance of course being the length of mandrel 12. Together, spindles 90, 92, which comprise piston-and-cylinder hydraulic motors, comprise the prime mover 36 for shifting the mandrel 12 back and forth as the flitches 22, 24, 26, 28-are sliced. Hydraulic fluid can be pumped at constant volume per unit time from a reservoir 104 by a pump 106 first into a first, 90, of the spindles 90, 92 while hydraulic fluid is exhausted from the other spindle 92 back to the reservoir. Hydraulic fluid is then pumped at constant volume per unit time into the second spindle 92 while hydraulic fluid is exhausted from the first spindle 90 back into the reservoir 104. A two-way valve 108 synchronized 110 to the rotation of mandrel 12 comprises a suitable means to achieve the requisite shifting of mandrel 12. A linear positioner 112 continuously feeds back the mandrel 12 position to the control system.

Figure 5:
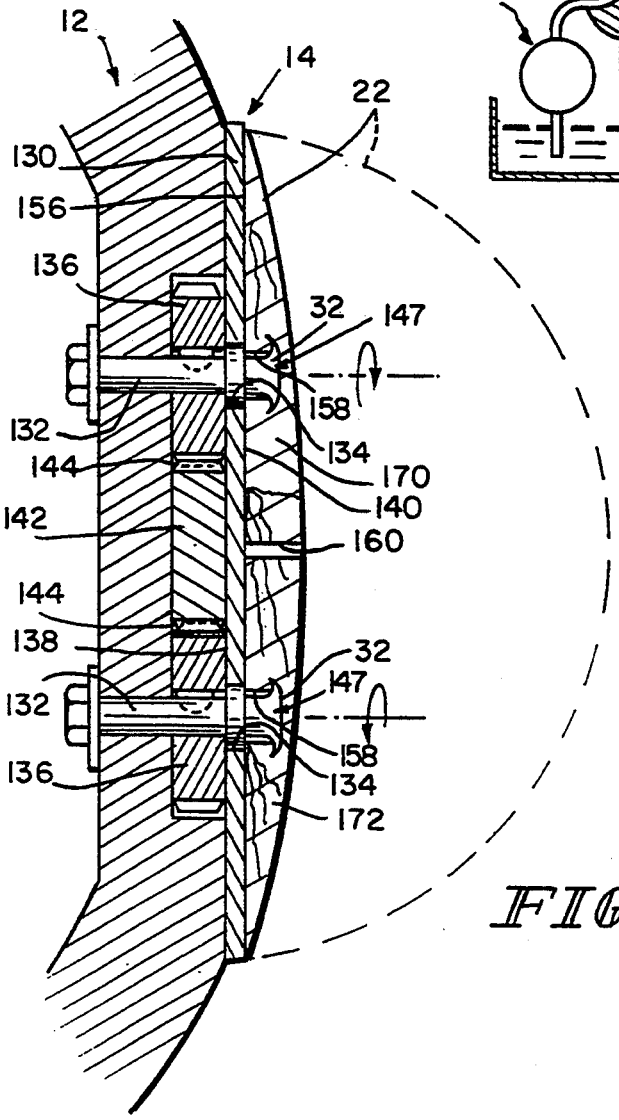
FIG. 5 illustrates a much enlarged sectional view of a detail of the system illustrated in FIGS. 1–4, taken generally along section lines 5—5 of FIG. 4.
Figure 6:
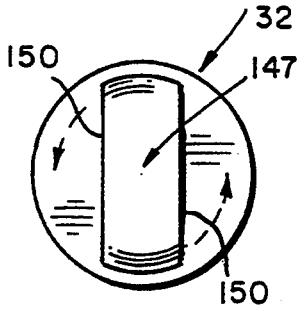
FIG. 6 illustrates a sectional view of a detail of FIG. 5, taken generally along section lines 6—6 of FIG. 5; and, FIGS. *7a–c* illustrate three different cutting profiles of which the system illustrated in FIGS. 1–2 is capable.
Figure 7A:
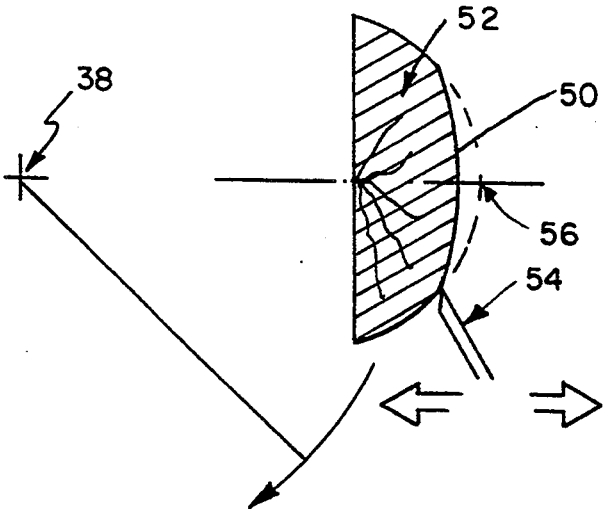
Figure 7B:
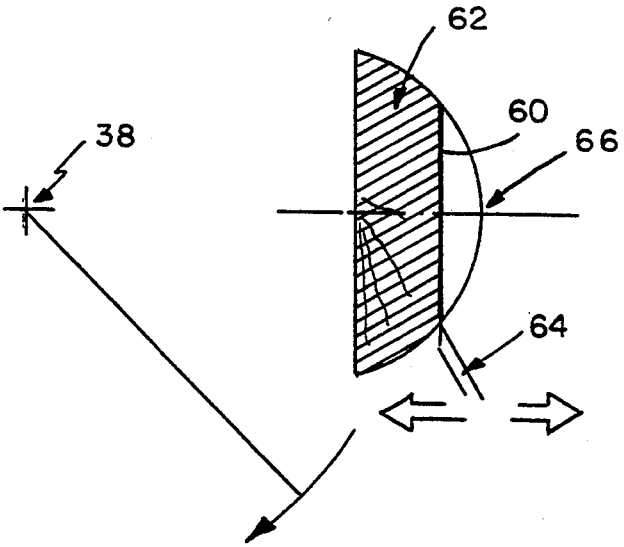
Figure 7C:
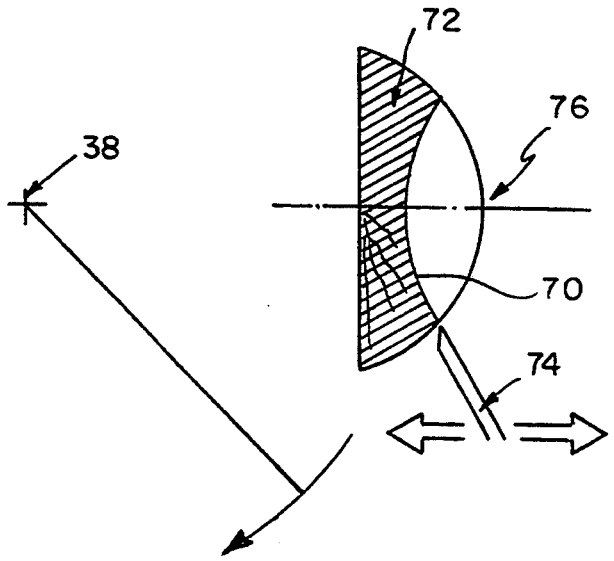

Turning now to FIGS. 5–6, each position 14, 16, 18, 20 on mandrel 12 is provided with a plurality of dogs 32, illustratively twenty (two parallel rows of ten dogs each) for holding a respective flitch 22, 24, 26, 28 for slicing. Position 14 and flitch 22, both in completely sliced (solid line) and unsliced (broken line) configuration, are illustrated in greater detail. A stainless steel backing plate 130 is provided at each of the flitch-mounting positions 14, 16, 18, 20. Typically, the backing plates 130 are bolted to the mandrel 12 by corrosion-resistant bolts, and the spaces between the bolts and plate 130 are filled with an inert epoxy. These steps and materials reduce the likelihood of corrosion of the backing plates 130, the bolts and, to the extent possible, the mandrel 12 by corrosive materials produced as the flitches 22, 24, 26, 28 are prepared for slicing and sliced. A driveshaft 132 protrudes through a bearing opening 134 provided therefor at each of the twenty locations on backing plate 130. A pinion gear 136 is provided on each driveshaft 132 adjacent the surface 138 of each backing plate 130 remote from its flitch-mounting surface 140. Dogs 32 are divided into two longitudinally extending groups of ten and a drive rod 142 with rack sections 144 provided thereon extends longitudinally between the two groups of dogs 32. The rack sections 144 engage respective pinion gears. The heads 147 of the dogs 32 are somewhat rectangular in plan view (FIG. 6) and sharp-edged 150. During the preparation of the flitch 22, 24, 26, 28 for slicing, the back surface 156 of the flitch is provided with two grooves 158 whose width is the same as, or slightly larger than, the width of the head 147 of the dog 32. The back surface 156 can also be provided with a saw cut 160 at the midpoint of its width. The depth of the saw cut 160 will vary depending upon, among other things, the hardness of the wood, the tightness of the grain, and the diameter of mandrel 12.

Once the flitch 22, 24, 26, 28 is positioned properly on its respective backing plate 130, the associated drive mechanisms, illustratively, hydraulic cylinders 162 mounted inside mandrel 12 are actuated through a hydraulic coupling 164 rotatably mounted on spindle 90 and held against rotation therewith by a linkage 166. This drives the drive rods 142 which are coupled to each such hydraulic cylinder 162 lengthwise of the flitch, turning the pinions 136 associated with each drive rod 142 a quarter turn, causing the sharp edges 150 of the dogs 32 to dig into the walls of each groove 158.

Slicing of the flitch proceeds as previously discussed until the knife and pressure bar assembly 42 reaches the saw cut 160. At that time, rotation of the mandrel 12 is stopped and one 170 of the two resulting pieces 170, 172 is turned end for end and re-mounted on the mounting plate 130 so that the grains of both pieces 170, 172 extend in the same direction. This reduces the likelihood of opening up the grain of the veneer that is sliced from pieces 170, 172 during the late stages of the slicing operation.

What is claimed is:

1. In a veneer slicer comprising a mandrel for holding multiple flitches, the mandrel having a first axis of rotation, means for rotating the mandrel, a knife and pressure bar assembly, a carriage and means for reciprocating the carriage toward the first axis of rotation as the flitches are carried around the first axis of rotation on the mandrel for reciprocating the knife and pressure bar assembly toward the first axis of rotation of the mandrel, rotation of the mandrel by the means for rotating the mandrel, coupled with reciprocation of the carriage toward the first axis of rotation as the flitches are carried around the first axis of rotation causing veneer to be sliced sequentially from said multiple flitches, means for movably mounting the knife and pressure bar assembly on the carriage and a linear fluid motor for moving the knife and pressure bar assembly with respect to the carriage, the fluid motor having two ends, the fluid motor fixed at a first of its ends to the carriage and at a second of its ends to the knife and pressure bar assembly.

2. The invention of claim 1 wherein the means for movably mounting the knife and pressure bar assembly comprises means for mounting the knife and pressure bar assembly for rocking motion with respect to the carriage about a second axis lying adjacent a cutting edge of the knife.

3. The invention of claim 1 or 2 wherein the means for reciprocating the carriage comprises means for reciprocating the carriage toward and away from the first axis of rotation to provide sheets of veneer having selected different profiles transverse to their lengths.

4. In a veneer slicer comprising a mandrel for holding a flitch, the mandrel having a first axis of rotation, means for rotating the mandrel, a knife and pressure bar assembly, a carriage, and means for reciprocating the carriage toward and away from the first axis of rotation as the flitch is carried around the first axis of rotation on the mandrel for reciprocating the knife and pressure bar assembly toward and away from the first axis of rotation of the mandrel to provide sheets of veneer having selected different profiles transverse to their lengths, means for movably mounting the knife and pressure bar assembly on the carriage and a linear fluid motor for moving the knife and pressure bar assembly with respect to the carriage, the fluid motor having two ends, the fluid motor fixed at a first of its ends to the carriage and at a second of its ends to the knife and pressure bar assembly.

5. The invention of claim 4 wherein the mandrel includes means for holding multiple flitches, rotation of the mandrel by the means for rotating the mandrel, coupled with reciprocation of the carriage toward and away from the first axis of rotation as the flitches are carried around the first axis of rotation causing veneer to be sliced sequentially from said multiple flitches.

6. The invention of claim 4 or 5 wherein the means for movably mounting the knife and pressure bar assembly comprises means for mounting the knife and pressure bar assembly for rocking motion relative to the carriage about a second axis lying adjacent a cutting edge of the knife.

7. In a veneer slicer comprising a mandrel for holding multiple flitches, the mandrel having a first axis of rotation, means for rotating the mandrel, a knife and pressure bar assembly, a first reciprocable carriage and first means for reciprocating the carriage toward the first axis of rotation as the flitches are carried around the first axis of rotation on the mandrel for reciprocating the knife and pressure bar assembly toward the first axis of rotation of the mandrel, and at least one linear fluid motor for reciprocating the mandrel along the first axis of rotation of the mandrel, rotation of the mandrel by the means for rotating the mandrel, coupled with reciprocation by the first means for reciprocating the first carriage and the at least one linear fluid motor for reciprocating the mandrel respectively toward the first axis of rotation and along the first axis of rotation as the flitches are carried around the first axis of rotation causing veneer to be sliced sequentially from said multiple flitches.

8. The invention of claim 7 and further comprising means for movably mounting the knife and pressure bar assembly on the first carriage and means for moving the knife and pressure bar assembly with respect to the first carriage.

9. The invention of claim 8 wherein the means for movably mounting the knife and pressure bar assembly comprises means for mounting the knife and pressure bar assembly for rocking motion with respect to the first carriage about a second axis lying adjacent a cutting edge of the knife.

10. In a veneer slicer comprising a mandrel for holding a flitch, the mandrel having a first axis of rotation, means for rotating the mandrel, a knife and pressure bar assembly, a first carriage, first means for reciprocating the first carriage toward the first axis of rotation as the flitch is carried around the first axis of rotation on the mandrel for reciprocating the knife and pressure bar assembly toward the first axis of rotation of the mandrel, and at least one linear fluid motor for reciprocating the mandrel along the first axis of rotation of the mandrel.

11. The invention of claim 10 wherein the mandrel includes means for holding multiple flitches, rotation of the mandrel by the means for rotating the mandrel and reciprocation of the mandrel by the second means, coupled with reciprocation of the carriage toward the first axis of rotation as the flitches are carried around the first axis of rotation causing veneer to be sliced sequentially from said multiple flitches.

12. The invention of claim 10 or 11 and further comprising means for movably mounting the knife and pressure bar assembly on the carriage and means for moving the knife and pressure bar assembly with respect to the carriage.

13. The invention of claim 12 wherein the means for movably mounting the knife and pressure bar assembly comprises means for mounting the knife and pressure bar assembly for rocking motion with respect to the carriage about a second axis lying adjacent a cutting edge of the knife.

* * * * *